US009038554B2

(12) United States Patent
de Troz

(10) Patent No.: US 9,038,554 B2
(45) Date of Patent: May 26, 2015

(54) MOBILE BALLAST DEVICE

(76) Inventor: Vincent de Troz, Joao Pessoa (BR)

( * ) Notice: Subject to any disclaimer, the term of this patent is extended or adjusted under 35 U.S.C. 154(b) by 0 days.

(21) Appl. No.: 14/110,698

(22) PCT Filed: Apr. 20, 2012

(86) PCT No.: PCT/EP2012/057259
§ 371 (c)(1),
(2), (4) Date: Oct. 8, 2013

(87) PCT Pub. No.: WO2012/143504
PCT Pub. Date: Oct. 26, 2012

(65) Prior Publication Data

US 2014/0033961 A1 Feb. 6, 2014

(30) Foreign Application Priority Data

Apr. 20, 2011 (LU) ..... 91809

(51) Int. Cl.
*B63B 39/02* (2006.01)
*B63B 39/03* (2006.01)
*B63B 43/08* (2006.01)

(52) U.S. Cl.
CPC ..... *B63B 39/02* (2013.01); *B63B 43/08* (2013.01)

(58) Field of Classification Search
CPC ..... B63B 39/02; B63B 43/08
USPC ..... 114/121–124
See application file for complete search history.

(56) References Cited

U.S. PATENT DOCUMENTS

| | | | | | |
|---|---|---|---|---|---|
| 704,885 | A | * | 7/1902 | Jensen | 280/152.2 |
| 1,853,069 | A | * | 4/1932 | Minorsky | 114/124 |
| 3,426,718 | A | * | 2/1969 | Webster et al. | 114/124 |
| 3,934,534 | A | * | 1/1976 | Larsh | 114/122 |
| 3,972,300 | A | * | 8/1976 | Adamski | 114/39.32 |
| 3,985,106 | A | * | 10/1976 | Ross | 114/91 |
| 4,094,263 | A | * | 6/1978 | Marcil | 114/91 |
| 4,117,797 | A | * | 10/1978 | Kelly et al. | 114/91 |
| 4,702,192 | A | * | 10/1987 | Butka | 114/122 |
| 4,867,089 | A | | 9/1989 | Haigis | |
| 5,433,162 | A | * | 7/1995 | Shigematsu et al. | 114/124 |
| 6,019,056 | A | * | 2/2000 | Maeda et al. | 114/122 |
| 6,349,660 | B2 | | 2/2002 | Chaix | |

FOREIGN PATENT DOCUMENTS

| | | | |
|---|---|---|---|
| AU | 2006201460 | B1 | 6/2007 |
| EP | 1110857 | A2 | 6/2001 |
| NL | 1036132 | C | 5/2010 |

(Continued)

OTHER PUBLICATIONS

International Search Report dated Jul. 13, 2012, for corresponding International Application No. PCT/EP2012/057259, 3 pages.

*Primary Examiner* — Daniel V Venne
(74) *Attorney, Agent, or Firm* — Seed IP Law Group PLLC

(57) ABSTRACT

The present invention discloses an inside mobile ballast arrangement for sailboats, said arrangement using a dense material and being preferably in a watertight/gas-tight compartment, the whole system on low friction bearings and being close to the bottom of the hull, this arrangement being able to move longitudinally from front to rear and vice versa, along the X axis, independently or simultaneously with a perpendicular displacement, i.e. from port to starboard and vice versa, along the Y axis.

20 Claims, 7 Drawing Sheets

(56) References Cited

FOREIGN PATENT DOCUMENTS

| | | | |
|---|---|---|---|
| SU | 880874 | A1 | 11/1981 |
| WO | 9119641 | A1 | 12/1991 |
| WO | 9216409 | A1 | 10/1992 |
| WO | 0147769 | A1 | 7/2001 |
| WO | 2009026964 | A1 | 3/2009 |

* cited by examiner (a)

(b)

(c)

MOBILE BALLAST DEVICE

TECHNICAL FIELD

The present invention relates to mobile ballast devices for boats, and in particular to mobile ballast devices for monohull sailboats.

BACKGROUND OF THE INVENTION

In order to ensure stability while sailing, a sailboat requires a system to counterbalance the thrust of the wind in the sails. For convenience, we shall denote a first longitudinal axis of a sailboat, running from bow to stern, as the X-axis. A second, transverse axis, running sideways from port to starboard will be called the Y-axis.

Overview of the Theory

As illustrated in FIG. 1*a*, the centre of buoyancy B is the centre of gravity of the volume of water 003 that is displaced by the hull 001. When a hull is subjected to no wind force, the hull's centre of gravity G and the centre of buoyancy B are on a same line, which is substantially perpendicular to the body of water 002.

As illustrated in FIG. 1*b*, a sailboat begins to tilt, or heel in the Y-axis, as soon as the wind presses into the sails 004. In all types of sailboats, either monohull or multihull, stability of the hull is in that case achieved by taking support on the water on one side (leeward) and using their weight on the other (windward).

When a vessel is heeled, the centre of buoyancy of the ship moves laterally, as shown in FIG. 1*b*. The righting arm GZ (or righting level) is the horizontal distance between the projection of the centre of buoyancy B and the projection of the centre of gravity G.

When the distance GZ between the fulcrum on water B and the centre of gravity G increases, the Righting Moment RM increases. The Righting Moment is the torque expressing the tendency of the hull to swing back into the position perpendicular to the waterline 002. Therefore, if the RM has a higher value, the sails of the boat can be larger as a higher wind force can be compensated. It follows that a higher RM indicates a higher speed potential of a hull. In boating, the power of a sailboat (provided by its sails area) is a compromise between two factors: the available RM and the "admissible discomfort" produced by the heeling. A sailboat designed to have a good RM is a boat having stiffness.

The sails' thrust force is situated at several meters above the sea level, while the hydrodynamic resistance force is located some decimeters under water. Both forces generate a tilting moment. The sails' thrust force becomes displaced by overboard when the sailboat is heeled.

The total aerodynamic force Fs is the sum of all forces generated by the sails and the rig. Fs is composed of the forward thrust Fx which is equal and opposite to the water resistance Rx (the water drag of the hull and appendages in the X-axis); the drift force Fy which is equal and opposite to the anti-leeway force Ry; the vertical force Fz, turned downward, which is to be added to the mass of ship.

As illustrated in FIG. 2, a torque is applied to the ship through the action of the force Fx. The arm of that torque is the height h. This torque affects the ship attitude relative to its horizontal X-axis and is similar as the heeling torque acting in the Y-axis. When the torque Fx.h inclines the vessel forward, the ship is pushed down by the head: it is trimmed by the head. The angle of trim $\tau$ is the incline of the vessel measured in the X-axis.

Wave making resistance is a form of drag that affects surface watercrafts, such as boats and ships, and reflects the energy required to push the water out of the way of the hull. This energy goes into creating the wake.

Discussion on the Y-Axis Aspect

Traditionally, lateral stability of a hull is provided by various means, depending on the type of ship under consideration. Multihull vessels, such as catamarans, have several hulls, thereby increasing the distance GZ while heeling. Big centreboard boats have inside or outside ballasts to lower their centre of gravity, keelboats have an outside fixed ballast also called fin keel. Some race keelboats have one or two canting keels, which allow the displacement of the boat's centre of gravity in order to increase the righting moment. This allows the hull to sail almost flat, thereby increasing its speed capabilities. Above all, canting keels are not well suited for boating in a port or at anchor. They are fragile elements that increase the draft of the boat, which is the distance between the waterline and the deepest point of the boat's structure, and may therefore be a recurring source of damage when navigating in shallow waters.

In addition, all these sailboats may have several inside ballast tanks, which are increasing their weight.

Discussion on the X-Axis Aspect

On the effect of the X-axis torque, the angle of trim increases when the thrust of the sails is increasing. Moreover, the Fz force is situated ahead of the centre of gravity—on the fore part of the ship—and exists at all courses once the ship is heeling. The X-axis torque and Fz force give rise to a loading effect on the fore section, which pushes the ship's nose down into the bow wave.

This loading effect involves the planes formed by fore walls of the hull, which act as an anti-drift. It significantly modifies the wetted areas of the hull. This has a consequence that the position of the anti-leeway force (whose centre is Ry) is moved forward. Furthermore the Fx point is swaying with the vessel movements. The points Rx and Ry are not static either, as they move back and forth. This leads to a situation of instability, in particular when the Fx point gets into a position that is situated behind the point of hydrodynamic resistance and the boat is subject to swings. That usually results in an involuntary course change in the best case, in a boat lying on the water, or in the worst case in a broken mast. Downwind sailing, in strong wind conditions, it will make sailboats too weather helm and unsteady on their way, which compromises seriously the safety of boats and crews.

Very few sailboats are equipped with a system for restoring or adjusting the trim angle. The simplest form of correction of the trim angle, used in small and medium sailboats, is so-called "live ballast", i.e. the weight of the crew. But this necessitates the presence of a crew and forces the crew to remain in a determined place.

Pleasure sailboats cannot exploit the trim tabs, which are used in motorboats, since it is necessary that the ship has a certain velocity so that the trajectory change of the water has a lifting effect on the ship attitude. This speed condition is certainly not achieved in sailing by pleasure boats.

In sailing races, many competitors use ballast tanks. This is an elegant solution insofar as water is abundant outside of the boat. When sailboats are equipped with ballast tanks, these are used not only to correct the trim angle, but also to increase the stiffness, by increasing the weight of the boat and hence its righting moment. However, water ballasts have imperfections: filling and draining problems due to factors like their position, clogging and ventilation of the strainers, inherent slowness of the system, overload when using, volumes occupied by the tanks on each sides in the accommodations, etc. These drawbacks make water ballast unsuited for boating.

Discussion about the Wave Making Aspect and Speed

Bows are designed to have a cutting effect in waves. This is achieved by providing a stem ending near the waterline by a forefoot (the part of a ship at which the prow joins the keel) and forming two walls. That kind of shape allows flattening the bottom of the hull, which is desirable to reach speed, and naturally makes the sidewalls of the hull more curved than the bottom, especially around the beam.

Therefore when sailing heeled, the hull waterlines are more curved. A consequence of this is an increased wave making resistance.

Moreover, the more the sails are tilted, the more significant is the Fz force, and the further the described loading effect pushes the boat's nose into the bow wave. These phenomena together worsen the depth of the bow wave and increase the resulting braking force. This in turn further increases the wave formation by the hull and therefore impacts negatively on the boat's speed performance.

There are therefore several disadvantages to having ballast fixed down the fin or centreboard. Principally, it is required to have several degrees of heeling before the righting moment becomes significant. Another drawback of such arrangements is that sailboats with fixed ballast remain unable to reach high speed by sailing heeled.

The more the boat is designed to go fast, the more it requires stiffness and trim correction. As a result, movable ballast systems have been proposed in the prior art.

EP-1-1 110 857 discloses a movable ballast system for a ship, the ballast being supported by lateral rails. The disclosed device does not allow balancing a longitudinal charge of the boat AU 2006 201 460 B1 discloses an adjustable ballast arrangement for a watercraft. As can be seen in the Figures example, the arrangement extends transversely thoroughly outside of the hull. Such a configuration is not capable of solving the balance of the longitudinal charge produced by the sails when the boat is sailing.

WO 91/19641A discloses an arrangement that is able to displace the balancing weight in a sailing boat, using a transversal rail. The mast must swing athwart ship to actuate the ballast. This concept appears to deteriorate the thrust force of the sails by acting more overboard, which generates an even more significant loading vector on the fore part of the boat. The suggested solution does not provide for the balancing of the longitudinal charge produced by the sails when the boat is sailing; at the contrary, it appears to amplify the problem.

Document U.S. Pat. No. 4,867,089 discloses various arrangements for moving an outside ballast element. Such a system however worsens the effects of water drag due to more immersed parts.

Document WO 92-16409 discloses a system intended to be a complement of water ballasts in ships. The ballast elements can only be moved along fixed trackways which define several crossings along two axes. The crossing points have to be used to change movement directions. The system is therefore not suitable for changing the ballast position quickly and precisely, which is required for efficient operation on a sailboat.

Document WO 01/47769A discloses a movable ballast arrangement for a boat. The arrangement is located in a conduit, which itself is preferably located inside the hull. The arrangement involves a closed loop tunnel, which contains spheres of different sizes. These ballast spheres are moved inside the tunnel by means of a worm gear, which engages through an opening in the tunnel with the smallest spheres. Considering the length of the described loops, the transfer of ballast from one side to the other takes about 20 seconds. However, a tack in real life is made in about 5 to 7 seconds; hence the proposed system would not appear to react quickly enough. More importantly, it is not possible to adjust both the trim angle and the heeling angle precisely and independently.

Another known ballast system has been disclosed by the applicant in WO/2009/026964. The system provides a mobile ballast, moving in a watertight tunnel in a horseshoe form. In order to balance any longitudinal charge, the ballast has to be moved laterally first. Likewise, this system is inappropriate for balancing a sailboat when it is sailing by wind stern, i.e., without heeling in the Y axis.

TECHNICAL PROBLEM TO BE SOLVED

It is an objective of the present invention to provide a device that overcomes or mitigates at least some of the disadvantages of the prior art.

SUMMARY OF THE INVENTION

According to a first aspect of the present invention, there is provided a device for changing the position of the centre of gravity of a ship or boat. The device defines a first and a second axis, said axes being substantially perpendicular to each other. The device comprises at least one ballast element, and first ballast moving means that are arranged to move said ballast element to any position in between a start and an end position along said first axis. The device further comprises first operating means that are arranged to drive said first moving means. Further, the device comprises second ballast moving means that are arranged to move said at least one ballast element to any position in between a start and an end position along said second axis independently of the ballast element's position along said first axis. Second operating means are arranged to drive said second moving means. At least one of said first and second moving means comprise at least one track element.

Said first operating means may preferably be arranged to drive said first ballast moving means along said first axis independently of said second moving means.

Preferably, said first moving means may be arranged to support said second moving means, and said second moving means may be arranged to support said at least one ballast element.

It is preferred that at least one of said first and second operating means may comprise an electrical motor.

Advantageously, at least one of said first and second operating means may comprise transmission means.

More preferably, at least one of said first and second moving means may comprise a chassis element, which is capable of moving along said at least one rail element.

It is preferred that at least one of said first and second moving means may comprise a ball screw.

Ballast supporting means may preferably be provided.

The device may advantageously comprise an enclosure, which comprises at least two sidewalls and a floor.

Preferably, the enclosure may be hermetically sealed.

More preferably, said enclosure may comprise a neutral atmosphere.

It is preferred that said first axis of the device may be oriented substantially along the bow-stern direction of said ship. Alternatively, said first axis may be oriented substantially along the port-starboard direction of said ship.

Advantageously, the device may be arranged close to the bottom of the hull of said ship.

According to a further aspect of the present invention, a ship comprising said device is provided.

Preferably, the ship may be a sailboat.

According to another aspect of the present invention, the use of said device for changing the centre of gravity of a ship is provided.

The present invention allows providing a movable ballast system for a boat, preferably inside the hull thereof. The ballast system is capable of displacing the ballast quickly along the bow-stern axis of the boat, independently or simultaneously with a perpendicular displacement, i.e. from port to starboard and vice versa. Thereby it allows for rapid and precise correction of the righting moment as well as of the trim angle of the boat. Indeed, the proposed system allows moving or dislocating the centre of gravity of a boat which is equipped with the system.

Some advantages of using movable ballast inside the hull are the diminution of water drag and the very small water-draft when the centreboard is raised. Other advantages include high stiffness with the boat sailing almost horizontal, enhancement of the comfort, and perhaps, the great reactivity and speed response if designed for.

BRIEF DESCRIPTION OF THE DRAWINGS

Several embodiments of the present invention are illustrated by way of figures, which do not limit the scope of the invention, wherein.

DETAILED DESCRIPTION OF THE INVENTION

Throughout the following description, like numerals will denote like concepts and elements in different embodiments, so that for example the numerals 100, 200, 300, 400, 500, 600 each describe a different embodiment of the device according to the present invention.

Figure 1:
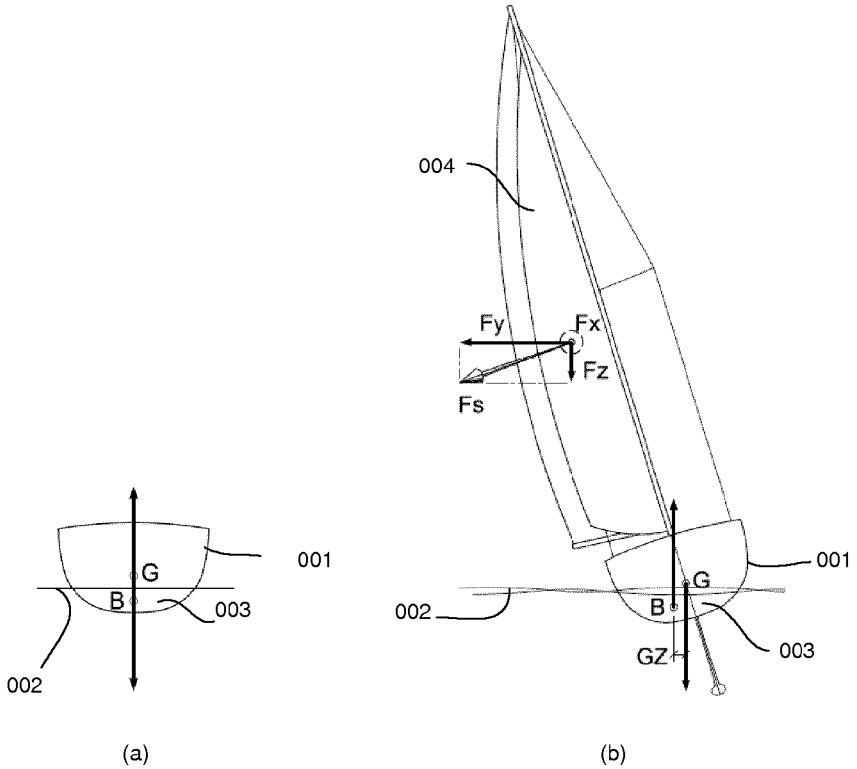
FIG. 1 is an illustration of the righting moment of a ship.
Figure 2:
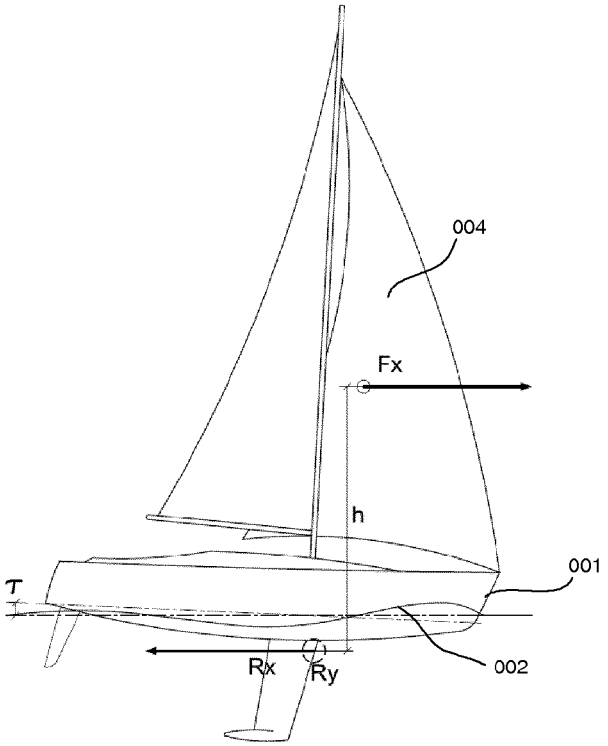
FIG. 2 is an illustration of the trim angle of a sailing ship.
Figure 3:
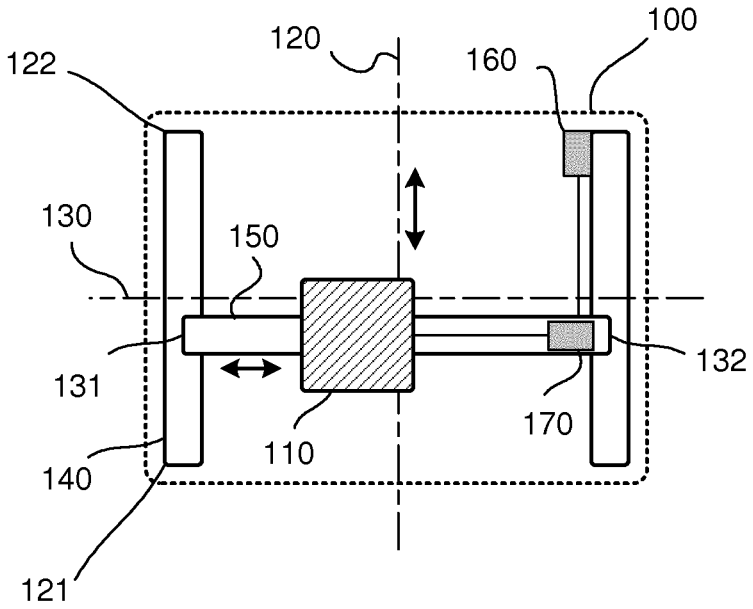
FIG. 3 is a schematic top view of a device according to the present invention.

As shown in FIG. 3, the device 100 according to the present invention provides a ballast element 110, which is movable along two axes 120, 130 independently. A first axis 120 is defined by first ballast moving means 140, on which the ballast can take any position between a start 121 and end position 122. A second axis 130 is defined by second ballast moving means 150, on which the ballast element 110 can take any position between a start 131 and an end position 132. Preferably, the second moving means 150 are supported by the first moving means 140. The moving means 140, 150 are driven by first 160 and second operating means 170.

Figure 4:
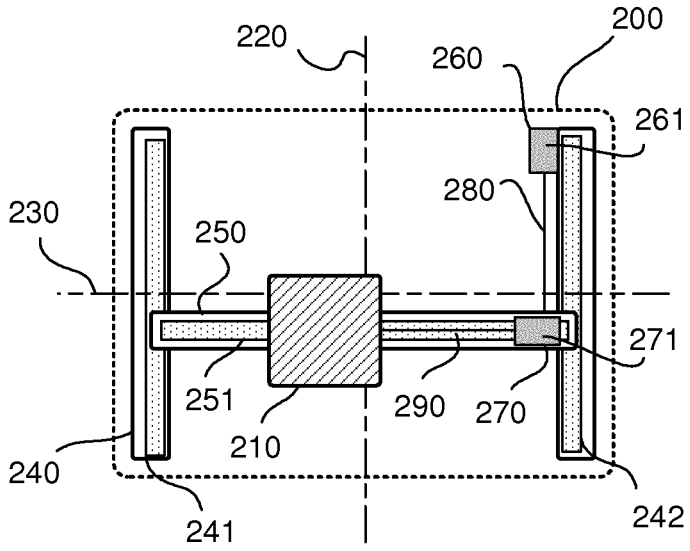
FIG. 4 is a schematic top view of a preferred embodiment of a device according to the present invention.
Figure 5:
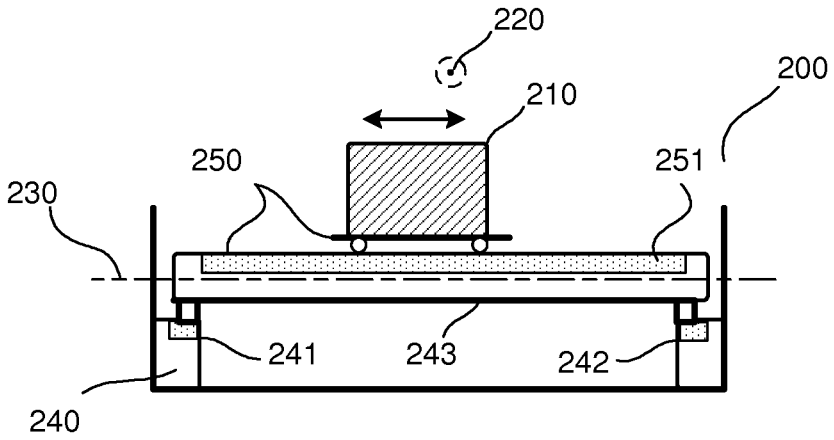
FIG. 5 is a schematic side view of a preferred embodiment of a device according to the present invention.
Figure 6:
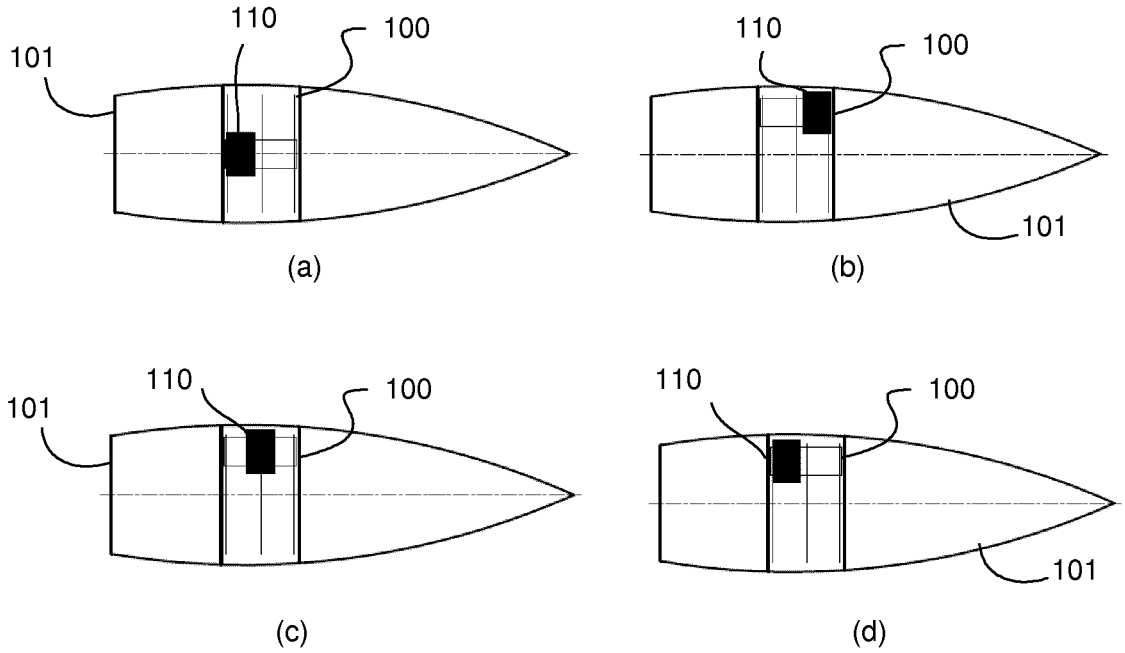
FIG. 6 is an illustration showing different positions of the ballast element in a preferred embodiment of a device according to the present invention.

As shown in FIG. 4 and FIG. 5, the operating means 260, 270 may for example be implemented by an electrical motor 261, 271 and respective transmission means 280, 290.

The first ballast moving means 240 may provide a first set of tracks 241, 242 on which a bogie-like element or chassis 243 is able to move along the said first axis 220. The chassis element 243 itself may support the ballast element 210, as well as second moving means 250 for moving the ballast element along the said second axis 230.

The described arrangement allows for positioning the ballast element in a multitude of positions, as shown in FIG. 6*a* to FIG. 6*d*, wherein a boat 101 comprising the ballast moving device 100 is also depicted. The ballast element 110 is movable on each axis independently of any possible movement on the other axis, by correspondingly actuating the respective operating means. Similarly, the ballast element 110 is movable along both axes simultaneously, which enables the system to quickly move the ballast element to any desired position, by correspondingly actuating the respective operating means.

This sets out the principle underlying the device according to the present invention in general terms. Details as to how to implement the device will now be outlined through the use of preferred embodiments, without limiting the scope of the invention to these illustrating examples.

Figure 7:
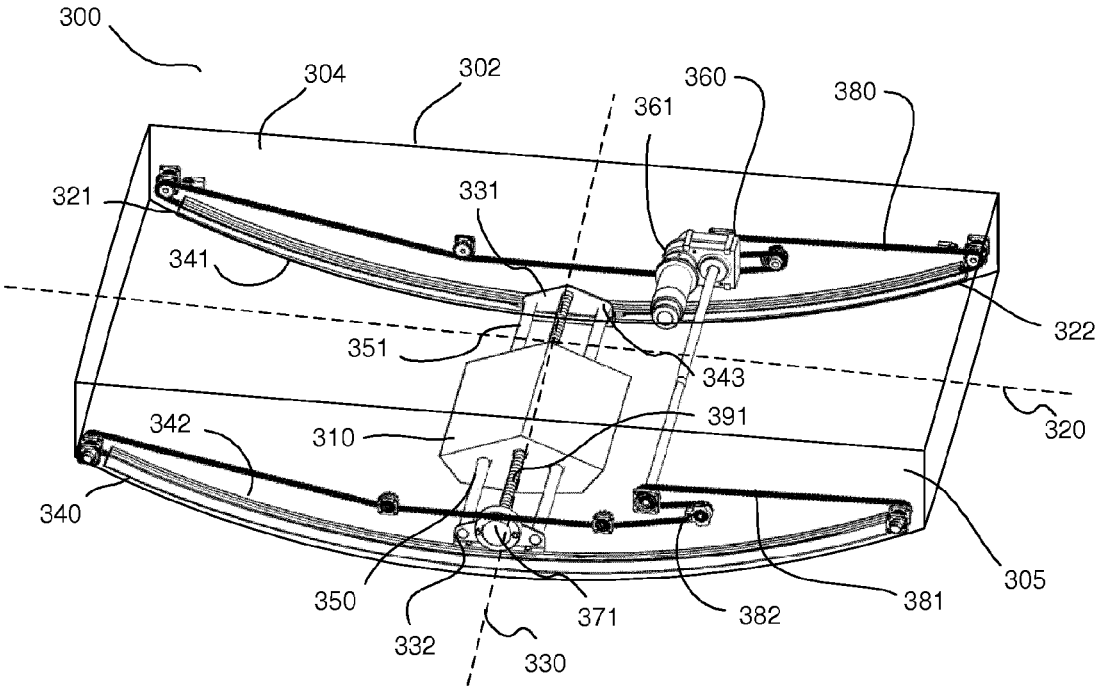
FIG. 7 is a perspective view of a preferred embodiment of a device according to the present invention.

As shown in FIG. 7, in a preferred embodiment, the device 300 according to the present invention comprises a containing compartment 302, which may be fitted in the belly of the hull of a boat. The compartment 302 provides at least two sidewalls 304, 305, wherein it is preferred that the sidewalls be integral with the bottom hull of the ship. A set of rails 341, 342 is fitted on or near, or along the said sidewalls, defining a first axis of movement 320. These rails or tracks 341, 342 are preferably in offset of the hull bottom. When the distance between the sidewalls is important, at least one intermediate supporting rail or track set may be provided on/near the bottom of the hull (not shown).

On the first set rails or tracks 341, 342, a vehicle chassis 343 or bogie is able to move along the first axis 320, from a start 321 to an end point 322, and vice-versa. The chassis comprises wheels or rollers, which enable it to move on the set of tracks. The rails or tracks, as well as the wheels of the chassis, are preferably profiled to allow the chassis to move accurately and without stall and/or derailment when the boat is sailing in a rough sea.

In the preferred embodiment of FIG. 7, the rails or tracks 341, 342 define a curve that follows the shape of the bottom part of a ship's hull. The start 321 and end 322 positions of the tracks are located in a horizontal plane, which is positioned higher than any other position along the tracks in between start and end. This effectively allows the chassis to be positioned in different horizontal planes, and therefore this allows the ballast element to be moved to different horizontal planes. As a consequence, this arrangement allows for lowering or heightening the position of the center of gravity, thereby heightening or lowering the effect of it.

The operation of moving the chassis along the first axis is provided by a geared electric motor 361, which is embedded in the compartment 302 itself. The transmission of the motor force to the chassis 343 is made by transmission means 380 comprising at least one roller chain 381 and corresponding sprockets 382, which are provided on at least one axis that is perpendicular to said sidewalls. The roller chains can be substituted by a pair of timing belts or by any other transmission means that will be known to the skilled person.

In the depicted preferred embodiment, the chassis or bogie 343 provides at least one track element 351, which extends along a second axis 330, wherein that second axis is substantially perpendicular to said first axis 320. The at least one track element 351 extends along the length of the chassis 343 and bridges the distance between the track elements 341, 342 provided along the first axis 320. The mobile ballast element 310 is placed so that it is able to move along the at least one rail element 351 or guide bar. This may be achieved through the use of bearings. The rails/guides/tracks 351 arrangement is designed to allow the ballast element 310 to move accurately and without stall (and/or derailment), in order to work reliably in all positions even in a rough sea. As shown in FIG. 7, it may be preferred to build the ballast element 310 so that it wraps around the track element 351. The shape of the ballast element is provided as shown in FIG. 7: it is advantageously house-shaped with a triangular roof. This allows for one flank of the roof shape to be in an essentially horizontal position with respect to the ship, when the ballast element is located at either the start 321 or the end position 322 along axis 320. As will be described below, the movement of the ballast element 310 along the track element 351 is, in a preferred embodiment, ensured by an electrical motor 371 arranged on said chassis 342, which transmits its power through a worm gear 391 that engages with a ball bearing 392 located inside the ballast element 310.

All electrical connections with the chassis 343 are ensured by a set of flexible electrical cables arranged in ribbon along the first axis 320, and are located between the chassis and hull, beneath the ballast element. These means are not illustrated for the sake of clarity of the figures.

The chassis power may alternatively also be supplied by a collector and carbon brushes that gather power from linear tracks, which can form part of the profiled rail tracks 341, 342 along the first axis 320.

The operating means 360, 370 for the motion of the ballast element 310 along both axes 320, 330, are each equipped with a brake motor that allows to stop and maintain the arrangement steady at the set point.

Figure 8:
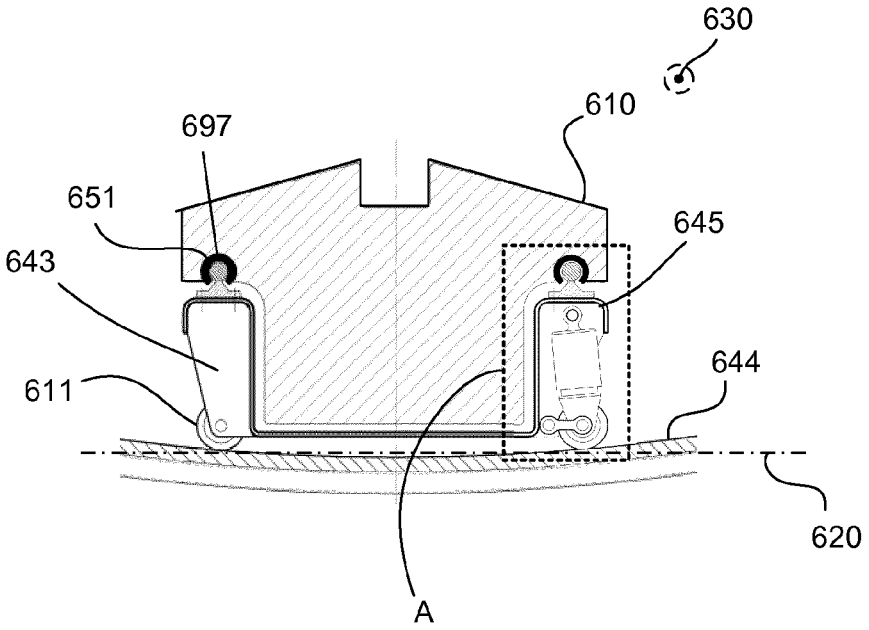
FIG. 8 is a sectional view along a first axis of a preferred embodiment of a device according to the present invention, showing a specific aspect of the embodiment.

If the distance between the rail or track elements 341, 342 is large, the chassis 343 needs to bridge an important distance. It is in such a case preferred to provide at least one additional rail or supporting element, arranged in parallel to and in between the rail elements 341, 342. The additional rail element is able to support the chassis' weight. A particularly preferred embodiment, as shown in FIG. 8, shows an additional supporting element 644, which is oriented along the first axis 620. The chassis 643 supporting the ballast element 610 is provided with rollers 611 that allow it to move along the first axis 620 on the supporting element 644. In practice, it is difficult to build the supporting element 644 perfectly in level with the main track elements 341, 342. In order to compensate for any level difference, the wheels or rollers 611 are preferably attached to the chassis 643 by means of a level compensating piston element, which is oriented downwards, as illustrated in the detail view A of FIG. 8. The piston element comprises at least a rod and a loaded spring, and it is capable of ensuring that the wheels contact the supporting element. Small level differences between the main track elements and the intermediate supporting element are thereby absorbed. As depicted in FIG. 8, the chassis preferably comprises a folded steel sheet 645 that supports the ballast element 610.

The at least one rail element or guide bar 651 may preferably be supported by means of, for example, an SKF™ linear system of the LRC series, 698. The ballast element is movable along the guide bar 651, oriented in the direction of the second axis 630, through the use of linear ball bushings 697.

Figure 9:
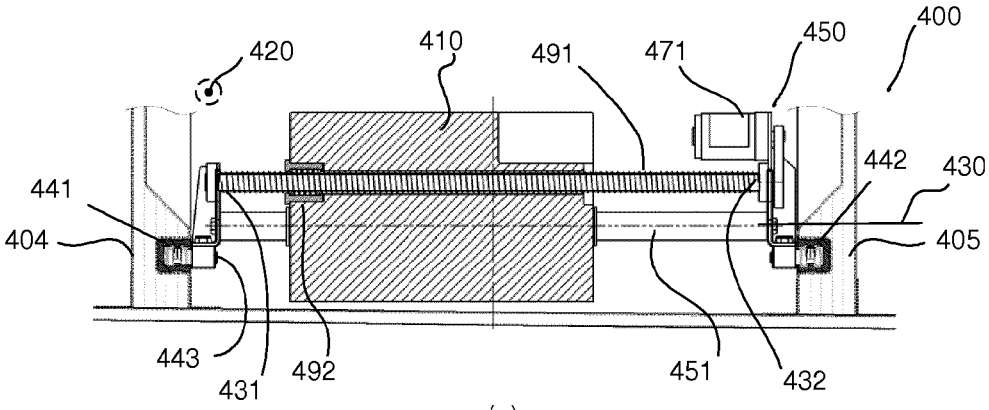
FIG. 9 shows three alternative embodiments of one aspect of a device according to the present invention in a sectional view along a second axis.
Figure 9:
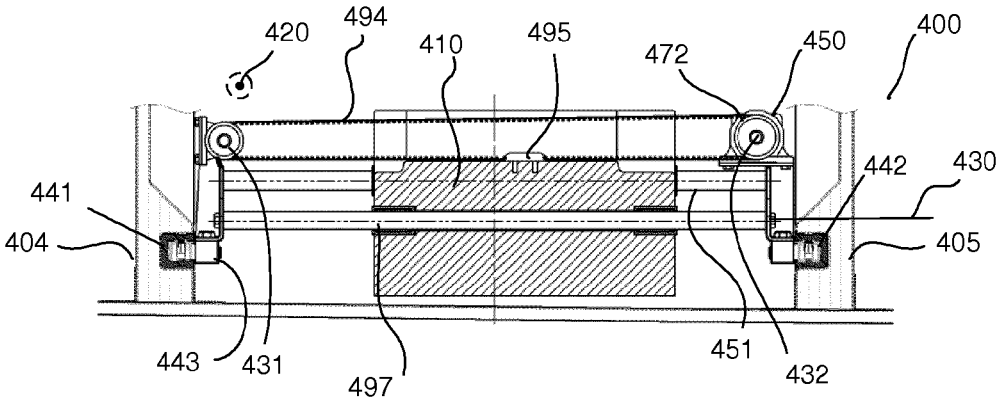
Figure 9:
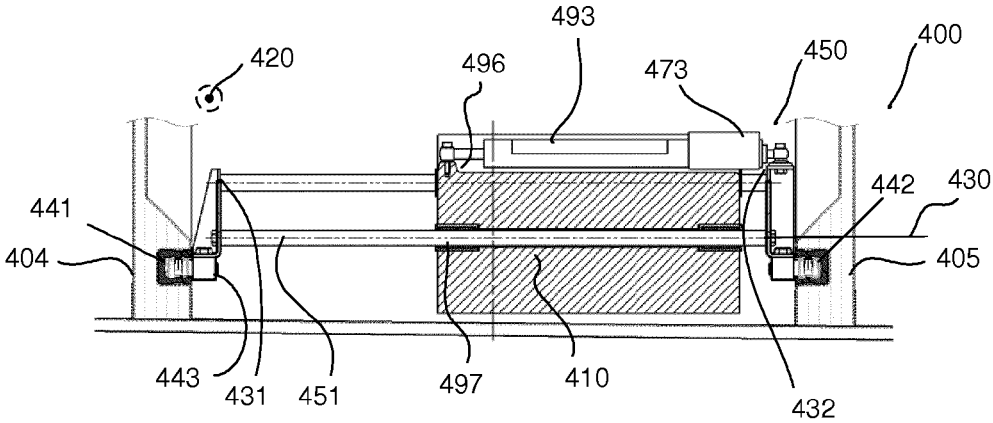

As shown in FIG. 9*a*, the ballast moving means 450 for achieving the movement of the ballast element 410 along the second axis 430 advantageously comprise an electrical motor 471 provided on the chassis element 443. Said electrical motor is preferably arranged so that during operation it drives a worm screw or a ball screw 491, as provided for example by the NSK™ Compact FA series. The worm screw or ball screw 491 extends along the length of the chassis and pierces through the ballast element 410. A ball bearing 492 inside the ballast element engages with the worm gear 491 and allows the ballast element 410 to be moved between the start and end positions 431, 432 respectively.

Alternatively, as shown in FIG. 9*b*, the ballast moving means 450 may comprise an electrical brake motor 472 provided on the chassis element 443, which is arranged so that during operation it drives a timing belt 494. The timing belt spans the distance between the start and end positions 431, 432 and is fixed to the ballast element 410 by anchoring means 495. Using this arrangement, and a ball bearing 497 inside the ballast element, the ballast element is movable between the start and end positions by operating the motor 472 accordingly.

In another alternative embodiment, as depicted in FIG. 9*c*, the ballast moving means 450 may comprise an electrical motor 473 provided on the chassis element 443, which is arranged so that during operation it drives an electrical jack screw 493, as provided for example by the SKF™ linear actuator of the CAR/CAP series. One end of the jack screw is fixed to the ballast element 410 by anchoring means 496, Using this arrangement, and a ball bearing 497 provided inside the ballast element, the ballast element is movable between the start and end positions by operating the motor 473 accordingly.

The above alternatives may be combined in order to implement precise motion at different speeds, when required. Other alternatives may be apparent to the skilled man.

Figure 10A:
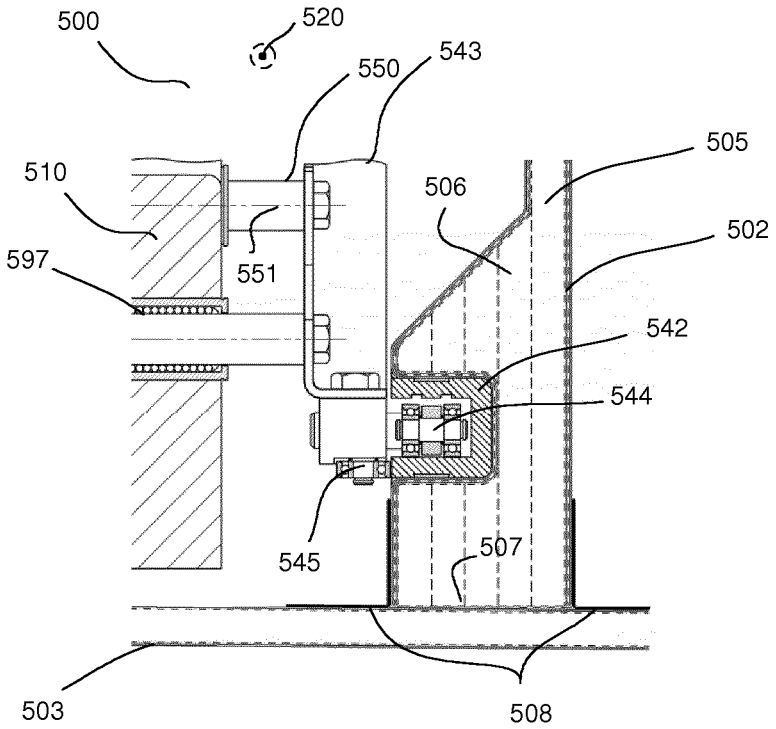
FIG. 10*a* shows a detail of a particular aspect of a preferred embodiment of a device according to the present invention in a sectional view along a second axis.

As illustrated in FIG. 10*a*, a set of machined or extruded tracks 542 in e.g. synthetic material may be provided. This reduces the noise of the chassis 543 moving along the first axis 520. The chassis 543 is provided with ball bearings 544 and 545, which ensure that the ballast element 510 can be moved in any sea condition.

In a preferred embodiment, the enclosure 502 is provided closed and under neutral atmosphere (e.g. argon or nitrogen), in order to prevent a chemical oxidation of the mechanical and electrical components. The compartment advantageously comprises a cover, which may be provided by at least one lid that is gastight when closed. The at least one lid may be provided with a membrane allowing the gas to expand or to contract with changes in temperature and atmospheric pressure. The compartment is preferably provided with a tap for argon or nitrogen refill. A pair of plugged holes is provided in each axis for crank in case of electrical damage. In a gastight configuration this system meets explosion-proof specifications.

Aside from being gastight, water tightness is required for the compartment in order to prevent intrusion and thus an obstruction by any object. The compartment may advantageously be hermetically sealed.

Given the forces generated by the ballast displacement and the movement of the boat on the sea, the sidewalls 504, 505—and particularly their lower part—must be capable of bearing with structural stress in all directions, and their connection with the hull needs to be provided in accordance. For hulls having counter moulded internal reinforcements (the majority of the yachting market nowadays) it may be preferable—in order to allow the ballast to be closer to the hull—to interrupt the counter moulded reinforcements between the sidewalls and replace them by a hull structure in laminated foam. Regarding the production of the sidewalls 504, 505, in a preferred embodiment shown in FIG. 10, they are made by involving stacked foam panels 506 laminated under vacuum. This well known method makes it possible to incorporate the track elements 542 reliably and easily. It is also preferred that the connection between the compartment 502 and the hull 503 is ensured by a slight cushion of resin charged with chopped strands 507, reinforced by two angled laminates 508, which unify the laminates 506 with the hull 503. This allows for a watertight binding between the hull 503 and the compartment 502.

Figure 10B:
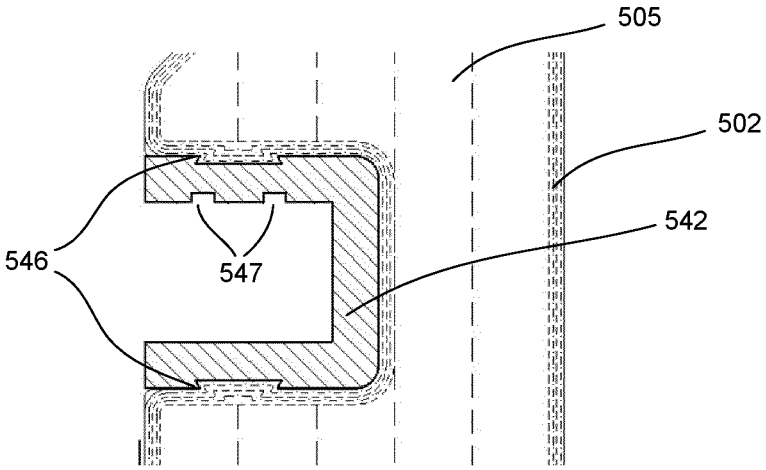
FIG. 10*b* shows a detail of a particular aspect of a preferred embodiment of a device according to the present invention in a sectional view along a second axis.

As shown in the detail view of FIG. 10*b*, it is preferred that the track elements 542 are provided with anchoring groves 546 that engage into corresponding anchoring protrusions provided in the laminated structure of the sidewall 505. A secure anchoring is important as the link between the track element and the sidewall may be subject to significant stress when the ballast element is heavy.

Furthermore, the track elements are preferably provided with a set of groves 547 in their ceiling part. The groves provide a guiding track for rollers that facilitate the movement of the chassis 543 along the track elements 542

The ballast element 110, 210, 310, 410, 510, 610 advantageously comprises a high-density material, such as lead. This allows the arrangement to be compact. If the device is compact, it may be installed beneath the floor of a boat, close to the bottom of its hull. The advantage is that it may be hidden by the accommodations.

The device according to the present invention may be set up on a boat so that said first axis is substantially collinear with the port-starboard direction of the boat, or in a substantially perpendicular direction thereto. In the remaining description, the first axis is supposed to be substantially oriented in the port-starboard direction of the boat.

The stiffness of the sailboat is increased by moving the ballast windward (along the first axis), to balance a part of the heeling. When needed, the trim angle may be corrected by moving the ballast toward rear or front (along the second axis). These operations are performed independently one of the other, or simultaneously as needed or desired. These operations are preferably performed electrically and automatically by computerized means, such as a Programmable Logic Controller (PLC). The PLC has preferably input information from various dedicated detectors or sensors and can also gather some information on the boat's NMEA (National Marine Electronics Association) bus.

On both axes, feedback concerning the position of the ballast element is preferably gathered by at least one sensor. This allows checking that the ballast element arrives at the set point. If the motors that drive the ballast moving means are not built with a rotary encoder embedded, one can for example us a sensor in the OMRON™ E6 series that can be coupled with the input or the output of speed reducer shaft.

Otherwise, such sensors may be implemented by counting pulses on transmission elements such as sprockets, by using an inductive proximity sensor, or by linear potentiometer, by laser meter, or by other means.

The position feedback allows programming a sloping deceleration along both axes, which permits driving the ballast element much faster and securely from one point to another. This ensures to stop the movement of the ballast element smoothly and allows saving power and sparing mechanical parts. A system equipped with a position feedback allows the ballast element to move along the first axis from one side to the other side in just 5 to 6 seconds, this timing being suitable e.g. for tacking a tack in a 40 ft sailboat.

Figure 11:
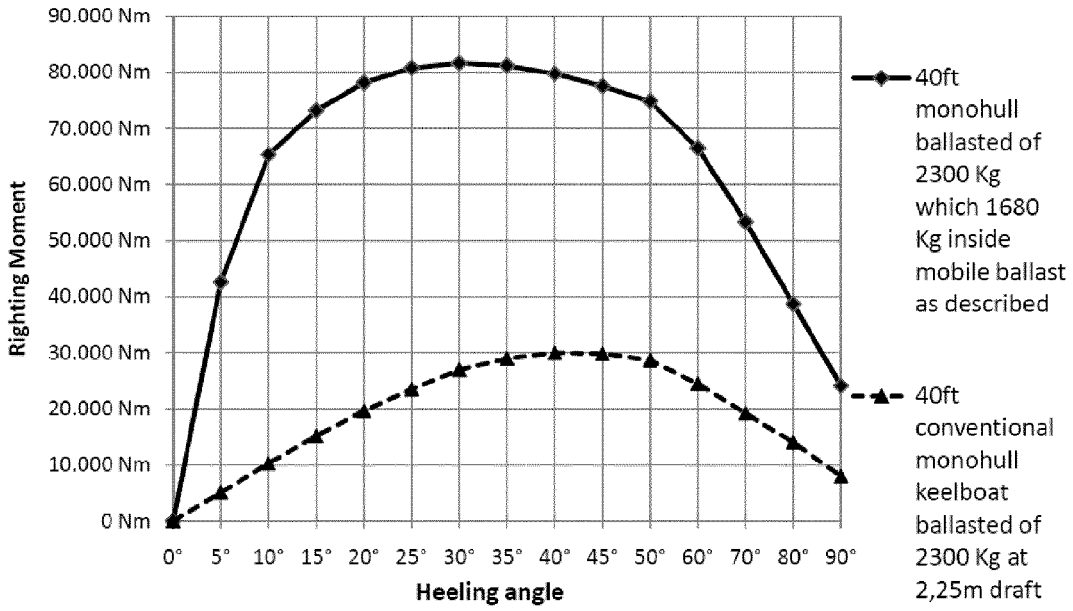
FIG. 11 shows a graph indicating the performance of a boat equipped with a device according to the present invention.

The graph in FIG. 11 shows the foreseen righting moment of a 40 ft monohull prototype ballasted of 2300 kg which 1680 kg inside mobile ballast as described here above vs a 40 ft conventional monohull keelboat ballasted of 2300 kg at 2.25 m draft.

Figure 12:
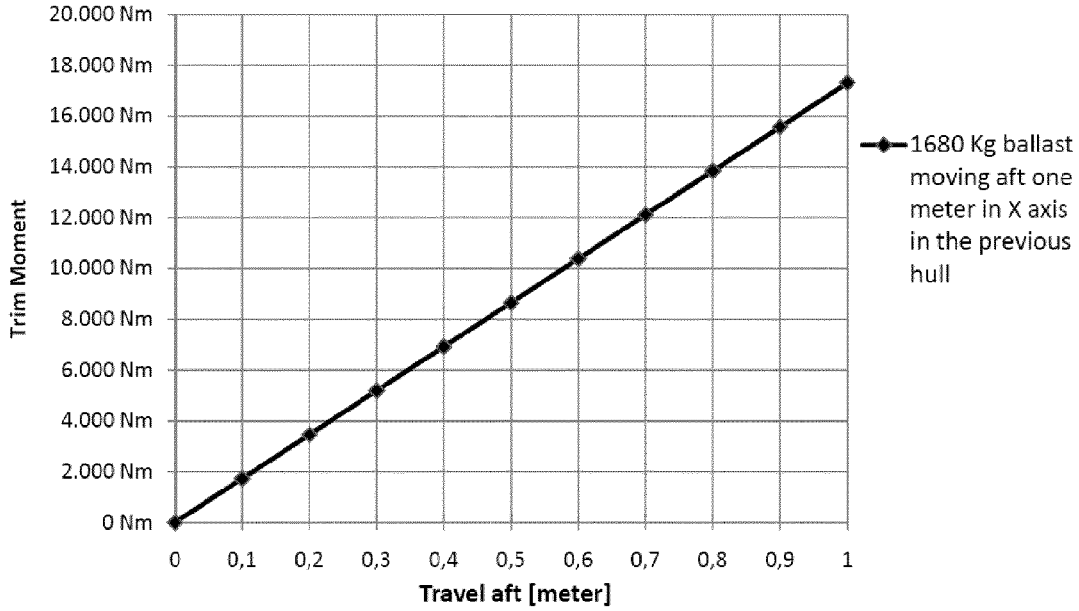
FIG. 12 shows a further graph indicating the performance of a boat equipped with a device according to the present invention.

The graph in FIG. 12 shows the foreseen trim moment of the said 1680 kg ballast moving aft one meter in X axis in the previous hull, what is obtaining a trim moment value of 17300 Nm. In terms of comparison with a conventional keelboat that would be equipped with a water ballast, 17300 Nm correspond to a ballast filled with 440 liters of water. The advantage here is obvious, since the movable ballast avoids having to overload 440 kg on a 12 meters boat.

The device according to the present invention allows providing a movable ballast system on a boat, wherein the ballast may be moved along two substantially perpendicular axes independently of each other. By proper operation of the provided device, the stiffness of the boat is substantially increased as the trim angle and righting moment of the boat may be quickly adjusted by placing the ballast element properly.

As a result, the boat equipped with a device according to the present invention, will be able to provide higher stability, to provide more speed, and to provide enhanced comfort. The reliability of the proposed device is ensured through the use of a containing compartment comprising an inert atmosphere.

As the appendages of the boat are reduced through the use of an internal ballast, drag is reduced, providing more speed, and draft is reduced, providing more versatility as compared to conventional keelboats.

It should be understood that the detailed description of specific preferred embodiments is given by way of illustration only, since various changes and modifications within the scope of the invention will be apparent to the skilled man. The scope of protection is defined by the following set of claims.

The invention claimed is:

1. A device for changing a position of a centre of gravity of a ship or boat, the device defining a first and a second axis, said axes being substantially perpendicular to each other, the device comprising at least one ballast element;

a first ballast moving means that moves said at least one ballast element to any position in between a start and an end position along said first axis;

a first operating element that is configured and arranged to drive said first ballast moving means;

a second ballast moving means that moves said at least one ballast element to any position in between a start and an end position along said second axis independently of the at least one ballast element's position along said first axis; and a second operating element that is configured and arranged to drive said second ballast moving means, wherein at least one of said first and second ballast moving means comprises at least one track element.

2. The device according to claim 1, wherein said first ballast moving means supports said second ballast moving means, and wherein said second ballast moving means supports said at least one ballast element.

3. The device according to claim 1, wherein said at least one track element defines a curve.

4. The device according to claim 1, wherein at least one of said first and second operating elements comprises an electrical motor.

5. The device according to claim 1, wherein at least one of said first and second operating elements comprises a transmission element.

6. The device according to claim 1, wherein at least one of said first and second ballast moving means comprises a chassis element, which is capable of moving along said at least one track element.

7. The device according to claim 1, wherein at least one of said first and second ballast moving means comprises a ball screw.

8. The device according to claim 1, wherein the device further comprises a ballast supporting element.

9. The device according to claim 1, wherein the device further comprises an enclosure, which comprises at least two sidewalls and a floor.

10. The device according to claim 1, wherein the device further comprises an enclosure that is hermetically sealed.

11. The device according to claim 10, wherein said enclosure comprises a neutral atmosphere.

12. The device according to claim 1, wherein said first axis is arranged to be oriented substantially along a bow-stern direction of said ship or boat.

13. The device according to claim 1, wherein said first axis is arranged to be oriented substantially along a port-starboard direction of said ship or boat.

14. The device according to claim 1, wherein the device is configured to be arranged close to a bottom of a hull of said ship or boat.

15. The device according to claim 1, which is included in a ship.

16. The device according to claim 1, which is included in a sailboat.

17. A method of operating a device for changing a position of a centre of gravity of a ship or boat, the method comprising:

providing the device defining a first and a second axis, said axes being substantially perpendicular to each other, the device including: (i) at least one ballast element; (ii) a first ballast moving means that moves said at least one ballast element to any position in between a start and an end position along said first axis; (iii) a first operating element that is configured and arranged to drive said first ballast moving means; (iv) a second ballast moving means that moves said at least one ballast element to any position in between a start and an end position along said second axis independently of the at least one ballast element's position along said first axis; and (v) a second operating element that is configured and arranged to drive said second ballast moving means, wherein at least one of said first and second ballast moving means comprises at least one track element; and operating said device to thereby change the position of the centre of gravity of said ship or boat.

18. The method according to claim 17, wherein said providing step includes orienting said first axis substantially along a bow-stern direction of said ship or boat.

19. The method according to claim 17, wherein said providing step includes orienting said first axis substantially along a port-starboard direction of said ship or boat.

20. The method according to claim 17, wherein said providing step includes arranging the device close to a bottom of a hull of said ship or boat.

* * * * *